US005546874A

United States Patent [19]

Breen et al.

[11] Patent Number: 5,546,874

[45] Date of Patent: Aug. 20, 1996

[54] LOW NOX INTER-TUBE BURNER FOR ROOF-FIRED FURNACES

[75] Inventors: Bernard P. Breen, Pittsburgh; John P. Bionda, Jr., Coraopolis, both of Pa.; James E. Gabrielson, Plymouth, Minn.; Roger W. Glickert, Washington, D.C.; Anthony Hallo, Springdale, Pa.

[73] Assignees: Duquesne Light Company; Energy Systems Associates, both of Pittsburgh, Pa.

[21] Appl. No.: 362,290

[22] Filed: Dec. 22, 1994

[51] Int. Cl.[6] ..... F23C 1/10

[52] U.S. Cl. ..... 110/261; 110/264; 110/347

[58] Field of Search ..... 110/106, 115, 110/261, 263, 264, 347, 265

[56] References Cited

U.S. PATENT DOCUMENTS

| | | | |
|---|---|---|---|
| 4,316,420 | 2/1982 | Kochey | 110/347 |
| 4,629,413 | 12/1986 | Michelson et al. | 431/9 |
| 4,669,398 | 6/1987 | Takahashi et al. | 110/347 |
| 4,739,713 | 4/1988 | Vier et al. | 110/263 |
| 4,748,919 | 6/1988 | Campobenedetto et al. | 110/264 |
| 5,020,454 | 6/1991 | Hellewell et al. | 110/264 |
| 5,299,929 | 4/1994 | Yap | 431/8 |
| 5,343,820 | 9/1994 | Marion | 110/264 |

FOREIGN PATENT DOCUMENTS

| | | | |
|---|---|---|---|
| 0275516 | 1/1990 | Germany | 110/261 |
| 0000906 | 1/1981 | Japan | 110/261 |

OTHER PUBLICATIONS

Zeldovich, Ya: Acta Physicohin; 21; 577.

*Primary Examiner*—Thomas E. Denion

*Attorney, Agent, or Firm*—Dickie, McCamey & Chilcote, P.C.; Leland P. Schermer; John N. Cox

[57] ABSTRACT

A method and apparatus for reducing the formation of nitrogen oxides during combustion in a roof-fired furnace is disclosed. By blocking at least some of the fuel nozzles associated with a roof-fired burner while leaving open the secondary air openings associated with the blocked fuel nozzles, reduction in NOX emissions from roof-fired furnaces is accomplished. This blocking results in the creation of a localized fuel-rich or just slightly fuel-lean environment near open fuel nozzles because part of the secondary air needed for combustion is being added at a location distant from where the initial combustion occurs. By creating a localized fuel-rich or slightly fuel-lean environment near the open fuel nozzles, the initial stages of combustion occur with little or no excess oxygen present. Because much of the fuel-bound nitrogen is liberated during the initial stages of combustion, it will preferentially react to form molecular nitrogen rather than nitrogen oxides because of the lack of available oxygen. Further, by the time all the secondary air is mixed with the pulverized coal to complete substantially the combustion, the flame temperature will have been sufficiently lowered by heat transfer to the boiler tubes that thermal formation of nitrogen oxides will be reduced. This invention works well in those roof-fired furnaces where individual burners are composed of multiple fuel nozzles and the fuel nozzles eject primary air and fuel between boiler tubes which form the furnace roof.

16 Claims, 4 Drawing Sheets

LOW NOX INTER-TUBE BURNER FOR ROOF-FIRED FURNACES

BACKGROUND OF THE INVENTION

1. Field of the Invention

The present invention relates to an apparatus and method for reducing nitrogen oxide (hereinafter referred to as NOX) emissions from a furnace that is vertically fired from multi-nozzle, inter-tube burners located in the furnace roof. This method of reducing NOX involves off-stoichiometric combustion to reduce the formation of NOX. In particular, the present invention relates to the use of combustion system modifications, such as blocking or eliminating at least some nozzles of a coal burner, to achieve higher coal to air ratios during initial combustion.

2. Description of the Prior Art

NOX emissions from combustion devices are a major regulatory concern in many industrialized countries. Nitric oxide (hereinafter NO), which is the usual form of NOX emitted from furnaces, is converted to nitrogen dioxide (hereinafter NO2) in the atmosphere in a matter of a few hours or days after emission. NOX emissions are currently the subject of strict regulatory control. Among the objectives of these regulations are: reduction of acid rain, reduction of smog, reduction of eye and respiratory irritation, and reduction of formation of ozone. Some laws and regulations governing NOX emissions have been in force for 25 years. Additionally, even more stringent regulatory control will become effective after 1995.

Empirical studies have identified two mechanisms for the formation of NOX in pulverized coal-air flames: (1) thermal reaction of nitrogen and oxygen contained with combustion air to form NOX (hereinafter thermal NOX), and (2) the oxidation of organically bound nitrogen compounds contained within coal to NOX (hereinafter fuel NOX). For conventional furnaces, thermal NOX formation becomes significant at temperatures above 2800 degrees Fahrenheit. Conversion of fuel-bound nitrogen to NOX can occur at much lower temperatures. Empirical studies have revealed that fuel NOX represents a substantial portion of the total NOX formed in a pulverized coal flame.

The reactions involved in the formation of thermal NOX are generally regarded to be:

(1) O2=O+O (2) O+N2=NO+N (3) N+O2=NO+O (4) N+N=N2

Reaction 1 is an equilibrium reaction and the atomic oxygen formed in this reaction is in equilibrium with the molecular oxygen (O2). The relative equilibrium concentrations of Reaction 1 is very temperature dependent and the amount of atomic oxygen is very small below 2800 degrees Fahrenheit. Also, the total amount of atomic oxygen is dependent upon the concentration of molecular oxygen in the combustion zone.

Atomic oxygen formed in Reaction 1 can react with molecular nitrogen to form NO and N, as shown in Reaction 2. Atomic nitrogen, which is formed in Reaction 2, is converted at an efficiency of 5 to 50 percent to NO, as shown in Reaction 3, depending upon the availability of molecular oxygen in the combustion zone. If the concentration of molecular oxygen is low, then the dominate reaction for atomic nitrogen will be Reaction 4 that results in molecular nitrogen (hereinafter N2). N2 is the desired reaction product.

These reactions have been studied, described, and quantified by Zeldovich. Zeldovich, Ya. B." Acta Physicohin, USSR, 21, 577. Therefore, to avoid thermal NOX formation, it is important to control the amount of coal that is burned in the combustion zone at temperatures above 2800 degrees Fahrenheit and to minimize the amount of excess oxygen in the combustion zone.

Fuel NOX is formed when fuel-bound nitrogen reacts with atmospheric oxygen. Fuel-bound nitrogen becomes atomic nitrogen (or part of a very reactive radical) when oxygen consumes the hydrocarbon molecule in which the fuel-bound nitrogen was originally located. Once atomic nitrogen become available in the combustion zone, it can react with molecular oxygen (Reaction 3) or it can react with another atomic nitrogen (Reaction 4). Reaction 3 is favored and NO is formed at efficiencies up to 50 percent, if there is excess air (which results in excess oxygen) present in the combustion zone. However, if there is little or no excess oxygen when the atomic nitrogen is liberated from the fuel, then Reaction 4 is favored and N2 is formed at efficiencies up to 90 percent.

Fuel-bound nitrogen contained in the volatile fraction of coal will be burned quickly because the volatile fraction of coal is evolved and burned within the first 200 milliseconds of combustion. This first 200 milliseconds represents the period in which atomic nitrogen from fuel-bound nitrogen in the volatile fraction is available for reaction. Therefore, to avoid fuel NOX formation, it is important to minimize or eliminate the amount of excess oxygen in the combustion zone where atomic nitrogen is formed.

NOX emissions from furnaces have been the subject of regulatory scrutiny for many years. Many successful devices and procedures have been used to reduce NOX emissions from furnaces. Fuels such as natural gas have no fuel-bound nitrogen and NOX emissions can be reduced by lowering flame temperatures. Reduced air preheat, flue gas recirculation and water injection have been used in various types of furnaces to reduce NOX emissions from natural gas combustion. However, these techniques are not effective in reducing the formation of fuel NOX. Oil fuel, which has some fuel-bound nitrogen, has sometimes been treated with the techniques used in natural gas combustion, but they are only partially effective.

The content of nitrogen by weight of coals typically burned by utilities can vary from 0.3% to over 2.0%. A coal having 1% nitrogen by weight and a heating value of 12,000 Btu per pound would emit the equivalent of 0.5 pounds of NOX per million Btu's, if only 20% of the fuel-bound nitrogen was converted to NOX. Any thermal NOX would add to this amount. Therefore, to meet expected emission limits and current limits for some furnaces (0.5 pounds of NOX per million Btu's of heat input) it is necessary that no more than 20 percent conversion of the fuel-bound nitrogen be converted into NOX. Numerous techniques have been tried to achieve these goals.

Slowly mixing or controlled mixing burners have been used on face fired and tangential fired furnaces to reduce NOX emissions. While some success has been achieved with these method, they are expensive and may result in increased carbon in the fly ash. Increased fly ash carbon can disrupt the functioning of the particulate removal devices and may cause destructive and dangerous fires in the back end of the combustion device. Controlled mixing burners have also been tried on roof-fired furnaces, but their application has been limited.

The roof-fired design which is of primary concern to the present invention uses multi-nozzle, inter-tube burners. The roof-fired design represents a relatively unique style of furnace that was designed and constructed in the late 1940's and early 1950's. The nitrogen oxide emissions from these units have not been extensively studied by applicants, but the emissions are believed to above levels allowed by current or imminent regulations. Existing NOX reduction technology can not be easily applied to these roof-fired units. A retrofit using existing NOX reduction technology is expensive, costing approximately six to seven times the cost of a conventional wall-fired furnace retrofit. Consequently, there is a need for a combustion apparatus and method which will both reduce nitrogen oxide emissions in flue gas and which can be readily used in existing roof-fired furnaces.

Many roof-fired furnaces have uniquely designed fuel delivery and burner systems. In these systems, coal is pulverized or milled so most of the coal will pass through a 70 mesh screen. The milled coal is then blown into the furnace by 10 to 25 percent of the combustion air. The coal and air from the pulverizer is divided into several pipes, each pipe supplying a burner which is typically 12 to 48 inches in diameter. This coal pulverization and delivery system is typical of many furnaces, but in some roof-fired furnaces the coal burner is further divided into 4 to 16 nozzles before the air and coal is discharged into the furnace. The burners are located in the roof of the furnace and the fuel is fired vertically downward. Different furnaces will have different numbers of pulverizers, burners, and nozzles per burner. These nozzles are only about 1 to 3 inches in diameter. The secondary air also is supplied through opening which usually are not more than 4 inches wide. Typically, there are multiple secondary air openings for each nozzle. The small size of these nozzle and secondary air openings allow the coal, primary air, and secondary air to be discharged into the furnace through spaces in between boiler tubes in the roof of the furnace. This type configuration is known as a multi-nozzle, inter-tube burner.

To retrofit roof-fired furnaces which currently employ the multi-nozzle, inter-tube burner with new lox NOX burners requires substantial modification to the furnace roof. The furnace top for roof-fired furnaces is usually defined by boiler tubes between which there are spaces. The nozzles and secondary air pass through these spaces. These tubes must be cut out and replaced with bent sections to allow new low NOX burners to be installed. This can be an expensive retrofit.

Another type of retrofit is the addition of NOX ports or overfire air ports. Typically, low NOX burners are installed in combination with overfire air ports. With overfire air ports, some combustion air is diverted from the burners and supplied to the overfire air ports. This results in the early stages of combustion (about 0.2 to 0.5 seconds) occurring in a fuel-rich environment. Because fuel-bound nitrogen contained within the volatile portion of coal is generally evolved during the first 200 milliseconds of combustion, the overfire air enters the combustion process after this fuel-bound nitrogen has been liberated. Because this fuel-bound nitrogen is liberated in a fuel-rich environment, it will preferentially react with atomic nitrogen to form N2 and will not react with molecular oxygen in significant amounts to form NOX. Further, because of the delayed addition of combustion air from the overfire air ports, the average combustion temperature has been reduced by heat transfer to the boiler tubes. This lowering of the combustion temperature will reduce thermal NOX formation.

However, the system just described has numerous drawbacks when applied to a roof-fired unit that uses nozzles to discharge coal into the furnace. Installation of the low NOX burners and overfire air ports requires modification and replacement of many boiler tubes in the furnace roof. The wind box must be converted to accommodate new and expensive low NOX burners. Duct work must be installed to bring overfire air from existing duct work or the windbox to the overfire air ports. Refractory throats must be constructed for both the burners and the overfire air ports. Dampers must be installed for the overfire air ports. Typically, when overfire air ports are installed, there is no easy method of adjusting the distribution of combustion air to assure substantially complete combustion while achieving the required level of NOX reduction.

As shown above, economical methods of retrofitting low NOX systems to roof-fired furnaces using multi-nozzle, inter-tube burner are not generally available. Such systems as are available have experienced only limited testing with natural gas, fuel oil, and pulverized coal.

Various back end or later furnace treatments to reduce NOX after it has been formed during combustion are available and are used in certain situations. One process is referred to as thermal deNOX, non-catalytic deNOX, or selective non-catalytic NOX reduction (hereinafter SNCR). Another process is referred to as selective catalytic NOX reduction (hereinafter SCR). Both of these require ammonia (hereinafter NH3), a toxic and difficult to handle gas or pressurized liquid. SNCR requires very careful injection of vaporized and diluted ammonia at a very narrow temperature window which may move in the furnace as load or other conditions change. SCR requires a very expensive catalyst. These systems are so expensive as to be practical only where the most stringent laws are in force and after the less expensive measures to reduce NOX formation during combustion have been taken. Further, these deNOX processes are usually applied to furnaces which only fire natural gas or oil.

Reburn, or in-furnace NOX reduction, is a technique where a fuel, usually natural gas or other high grade and expensive fuel which contains little or no fuel-bound nitrogen, is introduced in the furnace well downstream of the burners. The fuel is introduced in sufficient quantities to cause the gas stream to be fuel-rich. Temperatures of about 2000° F. to 2400° F. are desirable for this process but they are not always available before the gases flow through the convective passes of the furnace. The NO in the gas stream reacts with the fuel to form carbon dioxide, water vapor, molecular nitrogen, and fixed nitrogen compounds, such as, ammonia, hydrogen cyanide, and amines. Then enough additional air is provided to complete the combustion substantially and to make the gas fuel lean, preferably at the lower end of the temperature range. The fixed nitrogen compounds are oxidized to NO, and molecular nitrogen. Through this process the NOX is reduced by about 50%. The process is expensive to implement and reburn fuels are more expensive than coal. Additionally, many furnaces do not have sufficient volume to accommodate reburn.

Some efforts have been made to use remote or staged combustion to reduce NOX emissions. For example, Kochey, U.S. Pat. No. 4,316,420, discloses the introduction of a greater portion of the combustion air flow at location remote from where the fuel is initially burned.

Michelson, et al., U.S. Pat. No. 4,629,413, discloses blocking off secondary air ports near the fuel burner and reintroducing the secondary air at a remote location.

Hellewell, et al., U.S. Pat. No. 5,020,454, discloses the use of overfire air nozzles to inject overfire air at location remote from the coal burner.

And Yap, U.S. Pat. No. 5,229,929, discloses the use of secondary air nozzles to achieve staged combustion.

None of these prior art patents disclose an economic means of retrofitting roof-fired furnaces to reduce NOX emissions in the same manner as the present invention.

SUMMARY OF THE INVENTION

In accordance with the present invention, there is provided an improved apparatus and method for reducing NOX emissions in flue gas from roof-fired furnaces. The conventional multi-nozzle, inter-tube burner is modified by blocking specific fuel nozzles to achieve two-stage combustion. The first stage is the fuel-rich flame zone created by selectively blocking individual fuel nozzles and forcing the blocked fuel flow through remaining open fuel nozzles. The second stage results from the delayed addition of secondary air that flows from around areas adjacent to blocked fuel nozzles. This apparatus and method converts the conventional multi-nozzle, inter-tube burner into a low NOX burner.

Accordingly, it is an object of the present invention to provide a method and apparatus for reducing NOX formation in roof-fired furnaces that does not require extensive modification of the furnace. It is a further object of the invention to provide a relatively inexpensive method and apparatus for reducing NOX formation in roof-fired furnaces. It is still a further object of the invention to provide a method and apparatus for reducing NOX formation in roof-fired furnaces that employ two or more fuel nozzles for each coal burner to discharge primary air and pulverized coal through spaces between boiler tubes. It is yet another object of the invention to provide a method and apparatus for reducing NOX formation in roof-fired furnaces that does not increase unburned carbon and carbon monoxide levels in the flue gas to unacceptable levels. These and other objects are accomplished by the present invention, best understood by reference to the drawings and the detailed description of the preferred embodiment.

DETAILED DESCRIPTION OF THE PREFERRED EMBODIMENT

Figure 1A:
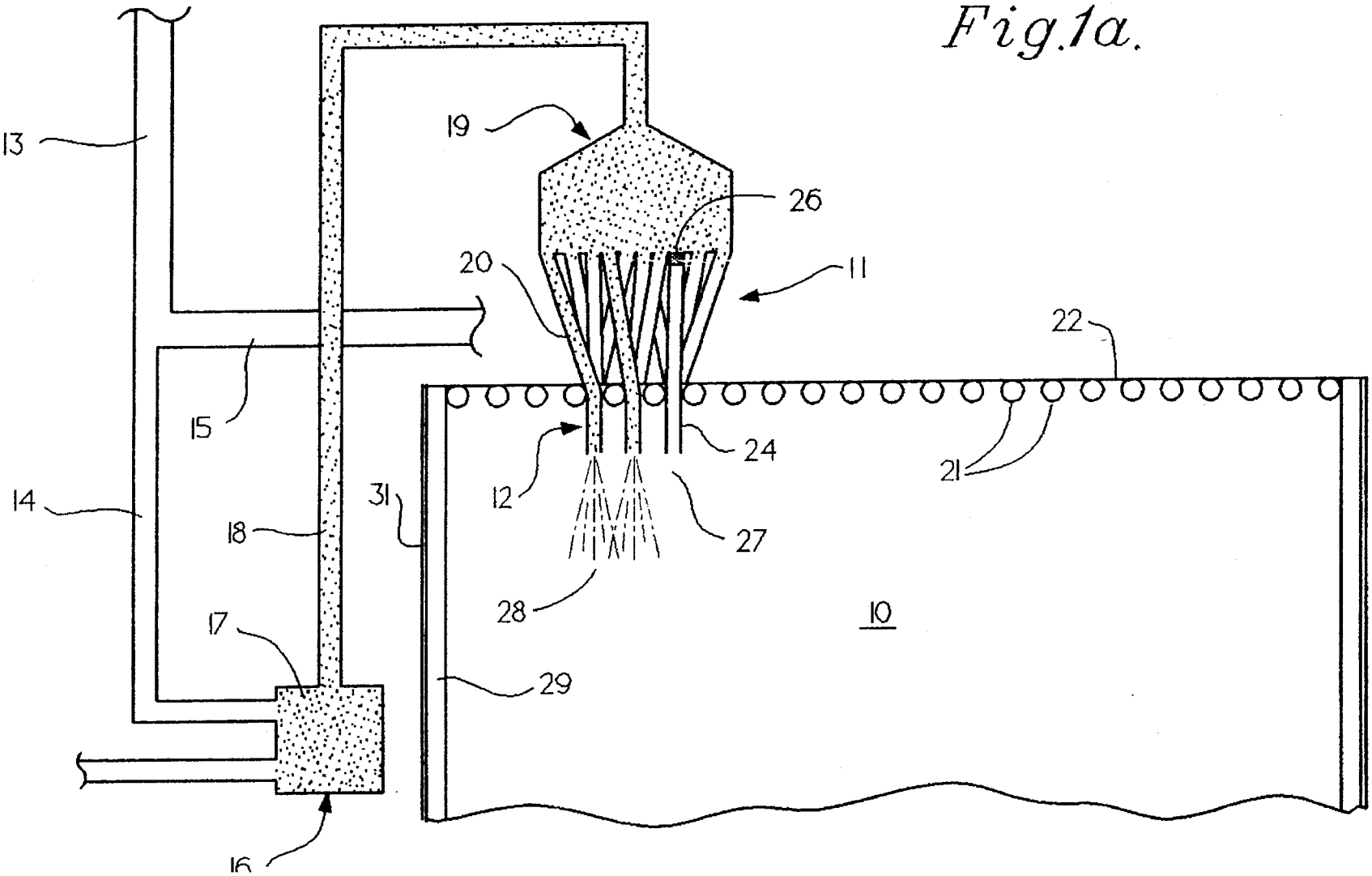
FIG. 1*a* is an overview of a conventional roof-fired furnace, wherein the burners comprise a plurality of fuel nozzles. The system for distributing secondary air is omitted for clarity.
Figure 1B:
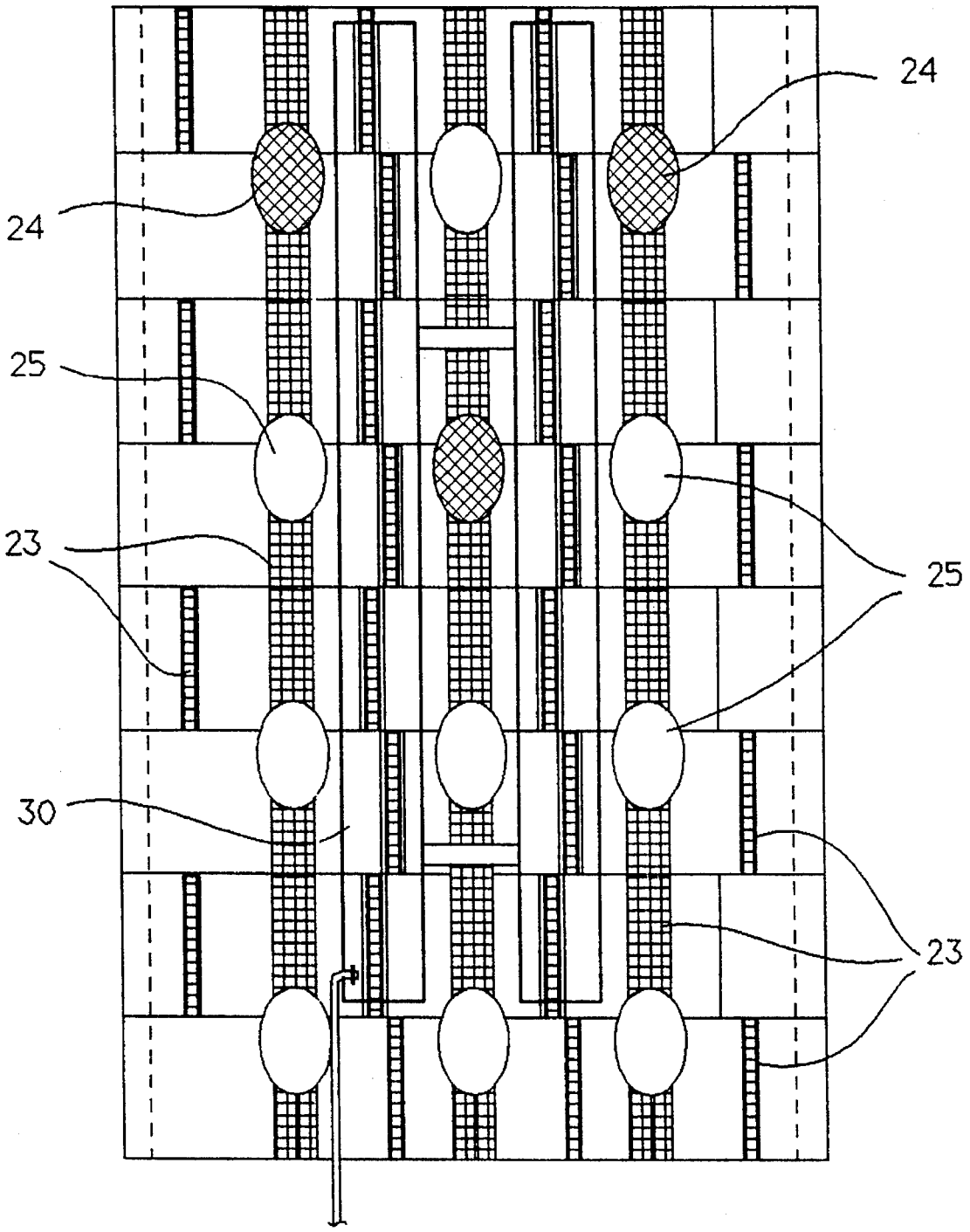
FIG. 1*b* is a plan view of the roof of a roof-fired furnace.
Figure 2:
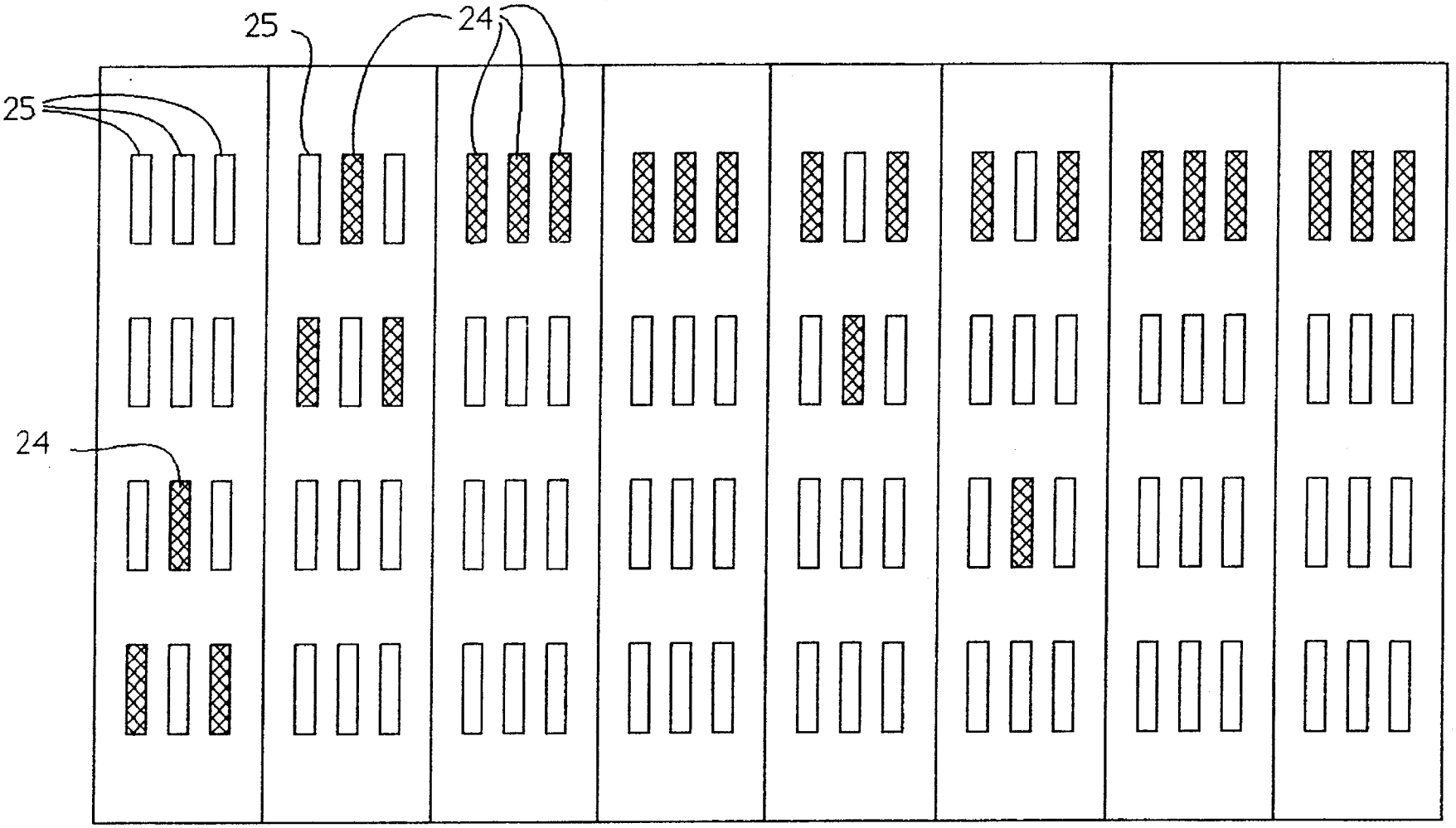
FIG. 2 shows a typical pattern of blocked and unblocked fuel nozzles for a furnace that uses eight burners.
Figure 3:
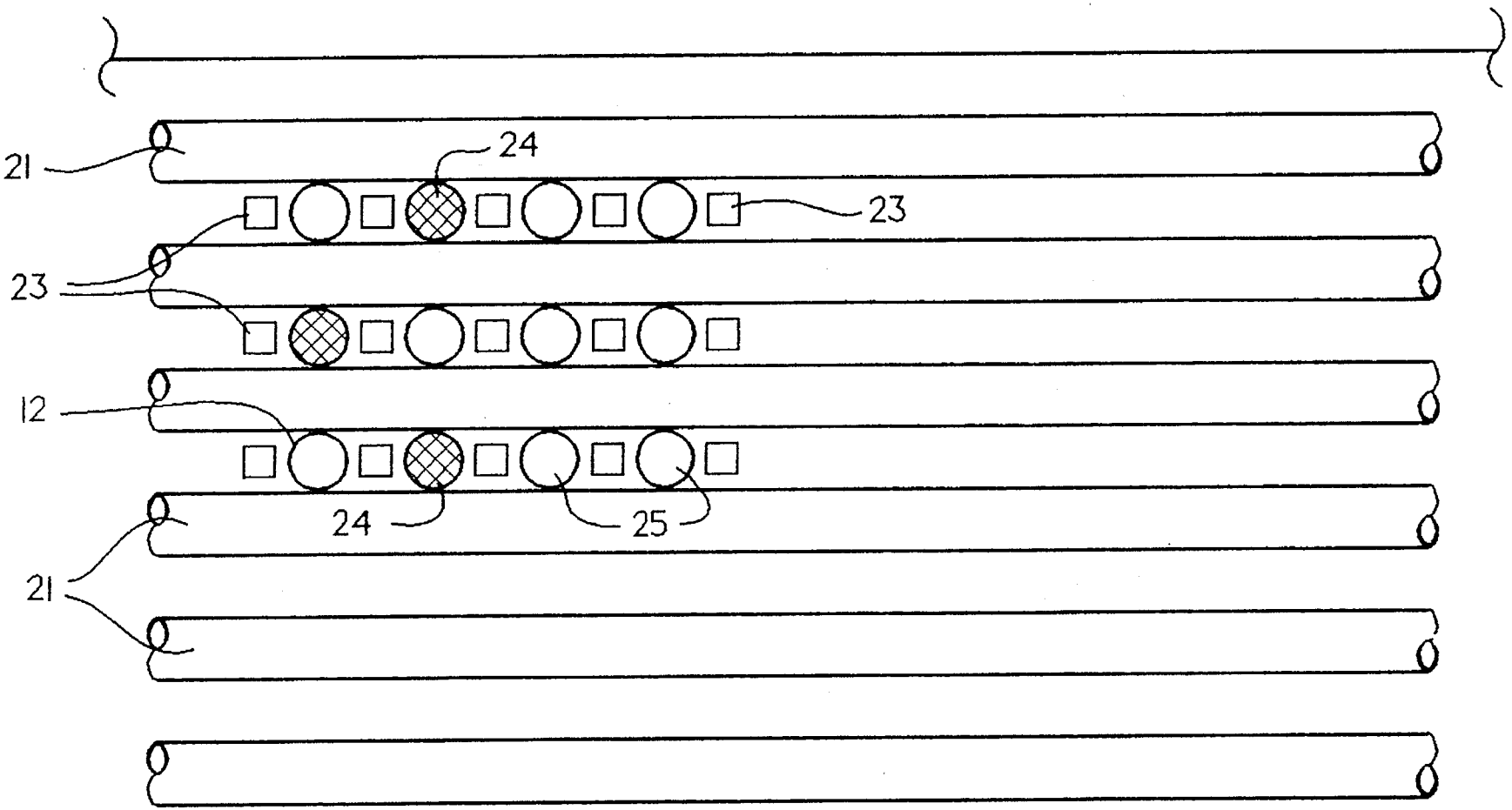
FIG. 3 shows 12 individual fuel nozzles which belong to a single burner.

Referring to FIGS. 1*a*, 1*b*, and 2, an improved apparatus and method for reducing the formation of NOX in a roof-fired furnace 10 is shown. A conventional inter-tube roof-fired burner 11 is modified by blocking at least some of a plurality of fuel nozzles 12 to create a two stage combustion process.

FIG. 1*a* shows combustion air 13 that is split into primary air 14 and secondary air 15. Primary air 14 is delivered to pulverizer 16. At pulverizer 16, primary air 14 picks up pulverized coal 17 and forms a mixture of pulverized coal and air 18. Mixture of pulverized coal and air 18 is delivered to roof-fired burner 11. At roof-fired burner 11, mixture of pulverized coal and air 18 is divided by riffle 19. Riffle 19 has a plurality of exit legs 20. Each exit leg 20 is connected to a fuel nozzle 12. Mixture of pulverized air and coal 18 is discharged into roof-fired furnace 10 through a plurality of fuel nozzles 12. Fuel nozzles 12 are used because the spaces between boiler tubes 21 that form roof 22 are not large enough for a conventional coal burner. Secondary air 15 is discharged into roof-fired furnace 10 through openings 23 that are adjacent fuel nozzles 12. There are multiple openings 23 for each fuel nozzle 12.

At least some of a plurality of fuel nozzles 12 associated with a particular burner 11 are blocked so that mixture of pulverized coal and air 18 can not flow through them. Blocked fuel nozzles 24 do not allow discharge of mixture of pulverized coal and air 18 into said roof-fired furnace 10. This results in all of mixture of pulverized coal and air 18 that goes to a particular burner 11 being discharged through unblocked fuel nozzles 25 of said plurality of fuel nozzles 12. Further, secondary air 15 continues to be discharged into roof-fired furnace 10 through openings 23, even those openings 23 that are adjacent blocked fuel nozzles 24.

Means 26 for blocking some of said plurality of fuel nozzles 12 can include placing an obstruction into riffle 19 to block an exit leg 20 that is connected to blocked fuel nozzle 24. Means 26 for blocking some of said plurality of fuel nozzles 12 can include placing a cap on the end of blocked fuel nozzle 23. Means 26 for blocking some of said plurality of fuel nozzles 12 can include placing a plug into blocked fuel nozzle 24.

The blocking results in two types of areas in roof-fired furnace 10 that are adjacent roof 22. Fuel-blocked areas 27 adjacent opening 23 that are near blocked fuel nozzles 24 contain very little fuel. Fuel-available areas 27 adjacent openings 23 that are near unblocked fuel nozzles 25 can be either fuel-rich or slightly fuel-lean. This results in the initial stages of combustion in roof-fired furnace 10 occurring under either fuel-rich or slightly fuel-lean conditions, which in turn reduces the formation of NOX. When the combustion products from fuel-available areas 28 mix with secondary air 15 from fuel-blocked areas 27, the combustion of pulverized coal 17 is substantially completed.

By delaying the mixing of secondary air 15 from fuel-blocked areas 27, NOX formation is reduced in two ways. First, fuel NOX formation is reduced by conducting the initial stages of combustion in a fuel-rich or just slightly fuel-lean environment. Second, thermal NOX formation is reduced because the delayed introduction of secondary air 15 from fuel-blocked areas 27, lengthens the combustion zone in roof-fired furnace 10. This lengthened combustion zone can be more readily cooled by heat transfer to boiler tubes 29 that form the sides of roof-fired furnace 10 and boiler tubes 21 that form roof 22.

In one embodiment about 15% to 35% of plurality of fuel nozzles 12 associated with burner 11 are blocked to create fuel-blocked areas 27.

In one embodiment, the flow of secondary air 15 is adjusted and redistributed to openings 23 to improve combustion efficiency or to reduce NOX formation. This is accomplished by using register 30 to decrease the amount of secondary air 15 that is discharged near unblocked fuel nozzles 25 if the measured NOX emissions are higher than allowed or using register 30 to decrease the amount of secondary air 15 that is discharged near blocked fuel nozzles 24 if the measured NOX emissions are lower than allowed.

In one embodiment, the distribution of blocked fuel nozzles 24 is adjusted to reduce formation of NOX, to decrease the level of CO in the flue gas, and to decrease the amount of unburned carbon in the fly ash. This is accomplished by measuring one or more process parameters to determine a distribution of blocked fuel nozzles 24. Those fuel nozzles 12 within a single burner group that produce flue gas with high CO concentration and low $O_2$ concentration are blocked. The distribution of fuel nozzles 12 to be blocked is determined by establishing a cross profile of CO and O2 at the point where the flue gas exits the economizer (not shown). The CO and O2 profile is determined by a multiple point sampling probe. The CO and O2 profile is then correlated back to combustion conditions at individual fuel nozzles 12. This correlation is accomplished by assuming generally parallel streamline flow from fuel nozzles 12 to the point where the flue gas exits the economizer (not shown).

In one embodiment, instead of blocking off at least some of plurality of fuel nozzles 12 associated with a burner 11, the entire flow of mixture of pulverized coal and air 18 is cut off to a selected burner 11 to create a fuel-blocked area 27 adjacent to the cut off burner.

In one embodiment, the reduction in NOX formation caused by blocked fuel nozzles 23 is enhanced by the use of overfire air ports located either in roof 21 or the sides 31 of roof-fire furnace 10. Mixture of pulverized coal and air 18 in roof-fired furnace 10 is discharged in a downward direction from a plurality of fuel nozzles 12 connected to burner 11. Overfire air ports located in roof 21 will discharge overfire air in a direction approximately parallel to the flow of mixture of pulverized coal and air 18. Overfire air ports located in the sides 31 of roof-fired furnace 10 will discharge overfire air in a direction approximately perpendicular to the flow of pulverized coal and air 18.

EXAMPLES

Examples 1 and 2 are given of a roof-fired furnace operated without the invention, so a comparison to these results can be used to determine how much improvement the invention makes. Examples 3, 4 and 5 illustrate the use of the invention. The Duquesne Light Company Elrama 3 furnace was used for all of the examples.

Example 1

Duquesne Light Company's Elrama 3 was operated to generate 85 MW of power. The oxygen in the flue gas was 6.5 percent. The NOX emissions were 0.60 pounds per million Btu ("lbs/MMBtu").

Example 2

Duquesne Light Company's Elrama 3 was operated to generate 98 MW of power. The oxygen in the flue gas was 5.7 percent. The NOX emissions were 0.63 lbs/MMBtu. This was repeated three times.

Example 3

Duquesne Light Company's Elrama 3 was operated at 103 MW. At the higher loads the NOX emissions are usually higher. This time 25 percent of the coal nozzles were closed. The oxygen in the flue gas was 5.3 percent. The NOX emissions were 0.34 lbs/MMBtu. The measurements were made at the same location and with the same equipment and procedures as in the previous examples. This NOX emission level is much below any value that could be achieved without this improvement in the burner. Also, the flue gas oxygen was not as low for Example 1, and lower flue gas oxygen usually corresponds to lower NOX emissions.

Example 4

The same unit was operated to produce 110 MW. Again 25% of the coal nozzles were blocked. The oxygen in the flue gas was 6.2%. The NOX emissions were 0.45 lbs/MMBtu. This is lower than Example 2 or Example 1. This improved operation made the NOX emissions lower for Example 4 than they were in Example 2, even though Example 2 was at a lower load and a lower oxygen level.

Example 5

Again the same unit was operated with 25 percent of the coal nozzle blocked. It was operated to produce 103 MW. The oxygen in the flue gas was 6.6 percent. The NOX emissions were 0.49 lbs/MMBtu. These NOX emissions were lower than the emissions for baseline Examples 1 and 2 which were achieved at lower load and lower oxygen levels.

The results from Examples 1 to 5 are shown in.

TABLE 1

EXPERIMENTAL DATA

| Example | Load (MW) | O2 in Flue Gas (%) | Nozzles Blocked (%) | NOX Emissions (lbs/MMBtu) |
|---|---|---|---|---|
| 1 | 85 | 6.5 | 0 | 0.60 |
| 2 | 98 | 5.7 | 0 | 0.63 |
| 3 | 103 | 5.3 | 25 | 0.34 |
| 4 | 110 | 6.2 | 25 | 0.45 |
| 5 | 103 | 6.6 | 25 | 0.49 |

Note: No overfire air was used in these tests.

COMPUTER SIMULATION PREDICTIONS

To model the invention a series of computer simulations were run to determine the NOX emission rate for the furnace operating at full load. In the simulation, the effect of blocking 25% of the nozzles and addition of overfire air was investigated. Table 2 shows the distribution of blocked nozzles and the various types of overfire air addition. Table 2 also shows the predicted NOX emissions. The simulation predicts NOX reductions of about 50% to 75% Additionally, the simulation shows that blocking 25% of the fuel nozzles results in NOX emissions below 0.5 lbs/MMBtu, which is an expected regulatory limit. However, some of the NOX reduction shown by the simulation is attributable to the introduction of overfire air.

TABLE 2

COMPUTER SIMULATION RESULTS

| Location of Blocked Nozzles | Type of Overfire Air | NOX (lb/MMBtu) | Carbon Index | Furnace Exit Temperature Index |
|---|---|---|---|---|
| Rear Row | Cross-flow, front wall | 0.56 | 20.18 | 2129 |
| Corners | None | 0.356 | 14.53 | 1820 |
| Rear Row | Centered on nozzle rows | 0.45 | 9.86 | 1767 |
| Rear Row | Off-centered from nozzles | 0.427 | 6.1 | 1488 |
| Corners | Off-centered from Nozzles | 0.39 | 6.3 | 1207 |
| None Blocked | None | 1.2 | 10.1 | 1767 |

While a present preferred embodiment of the invention is described, it is to be distinctly understood that the invention is not limited thereto but may be otherwise embodied and practiced within the scope of the following claims.

What is claimed is:

1. A method of reducing NOX emissions from roof-fired furnaces that use multi-nozzle inter-tube burners comprising the steps of:

a) blocking at least some of a plurality of fuel nozzles that discharge a mixture of pulverized coal and air into said roof-fired furnace from a roof-burner;

b) introducing secondary air around each of said plurality of fuel nozzles regardless of whether said fuel nozzle is blocked or not; and c) creating a fuel-lean environment adjacent said plurality of fuel nozzles that are blocked.

2. The invention of claim 1, wherein said introducing step further comprises reducing the air to fuel ratio adjacent said plurality of fuel nozzles that are unblocked and creating a fuel-rich combustion environment adjacent said plurality of fuel nozzles that are unblocked.

3. The invention of claim 1, wherein said introducing step further comprises increasing the air to fuel ratio adjacent said plurality of fuel nozzles that are unblocked and creating a fuel-lean combustion environment adjacent said plurality of fuel nozzles that are unblocked.

4. The invention of claim 1, wherein said blocking step further comprises blocking about 15 to 35 percent of said plurality of fuel nozzles associated with each coal burner.

5. The invention of claim 1 wherein said introducing step further comprises adjusting a distribution of said secondary air flow to improve NOX reduction or improve combustion efficiency.

6. The invention of claim 1, wherein said blocking step further comprises measuring one or more process parameters to determine a distribution of said fuel nozzles to block to optimize reduction of NOX, CO, and fly ash carbon.

7. The invention of claim 1, wherein said introducing step further comprises diverting a portion of said secondary air to overfire air ports.

8. The invention of claim 7, wherein said introducing step further comprises using overfire air ports located in a roof of said furnace to introduce said diverted portion of secondary air in a direction approximately parallel to the flow of said mixture of pulverized coal.

9. The invention of claim 7, wherein said introducing step further comprises using overfire air ports located in a side of said furnace to introduce said diverted portion of secondary air in a direction approximately perpendicular to the direction of flow of said mixture of pulverized coal.

10. In a roof-fired furnace of a type where a mixture of pulverized coal and air is delivered to a coal burner that leads to a plurality of fuel nozzles that discharge said mixture into said furnace, so as to mix and burn with secondary air, an apparatus for reducing NOX emissions comprising:

a) means for blocking some of said plurality of fuel nozzles wherein said blocking means forces said mixture of pulverized coal and air through one or more unblocked fuel nozzles to create fuel rich conditions for initial combustion and b) openings in the roof of said furnace adjacent said plurality of fuel nozzles wherein secondary air passes through said openings.

11. The invention of claim 10 wherein some of said plurality of fuel nozzles are removed instead of being blocked.

12. The invention of claim 10 wherein about 15 to 35 percent of said plurality of fuel nozzles are blocked.

13. The invention of claim 10 wherein said secondary air openings are adjusted to improve NOX reduction or combustion efficiency.

14. The invention of claim 10 further comprising overfire air ports.

15. The invention of claim 14 wherein said overfire air ports are on said roof of said furnace and a diverted portion of said secondary air passing through said overfire air ports enters said furnace approximately parallel to the direction of flow of said mixture of pulverized coal and air.

16. The invention of claim 14 wherein said overfire air ports are on sides of said furnace and a diverted portion of said secondary air passing through said overfire air ports enters said furnace approximately perpendicular to a direction of flow of said mixture of pulverized coal and air.

* * * * *